US011713742B1

(12) United States Patent
Nilsen et al.

(10) Patent No.: US 11,713,742 B1
(45) Date of Patent: Aug. 1, 2023

(54) DUCTED FUEL INJECTION SYSTEM ALIGNMENT DEVICE

(71) Applicant: National Technology & Engineering Solutions of Sandia, LLC, Albuquerque, NM (US)

(72) Inventors: Christopher William Nilsen, Livermore, CA (US); Drummond Edward Biles, Livermore, CA (US); Charles J. Mueller, Livermore, CA (US); Nathan Harry, Livermore, CA (US); Ralph Louie Dela Pena, San Mateo, CA (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 331 days.

(21) Appl. No.: 17/196,381

(22) Filed: Mar. 9, 2021

(51) Int. Cl.
*F02M 69/04* (2006.01)
*F02M 61/18* (2006.01)
(Continued)

(52) U.S. Cl.
CPC ..... *F02M 61/1846* (2013.01); *F01D 21/003* (2013.01); *F02B 23/0651* (2013.01); *F02B 2275/44* (2013.01)

(58) Field of Classification Search
CPC ..... F02M 61/1846; F01D 21/003; F02B 23/0651; F02B 2275/44
(Continued)

(56) References Cited

U.S. PATENT DOCUMENTS 8,967,129 B2 3/2015 Mueller
9,506,439 B2 11/2016 Anders et al.
(Continued)

FOREIGN PATENT DOCUMENTS

DE 894338 10/1953
FR 2880915 7/2006
(Continued)

OTHER PUBLICATIONS

Charles J. Mueller, Ducted fuel injection: A new approach for lowering soot emissions from direct-injection engines, Jul. 18, 2017, Applied Energy, pp. 3-5 (Year: 2017).*
(Continued)

*Primary Examiner* — Hung Q Nguyen
*Assistant Examiner* — Anthony Donald Taylor, Jr.
(74) *Attorney, Agent, or Firm* — Madelynne J. Farber; Medley, Behrens & Lewis, LLC; Samantha Updegraff

(57) ABSTRACT

An alignment device for a ducted fuel injection system comprising a mounting block removably attachable to a duct of the ducted fuel injection system. The mounting block can include a passageway extending therethrough. The passageway can align with the duct when the mounting block is attached to the duct. The alignment device further comprises an imaging device configured to capture an image viewing through the duct toward an outlet of a fuel injector. A portion of the imaging device can extend in the passageway. The alignment device additionally comprises a centering structure configured to align a portion of the imaging device with a central axis of the duct. The image captured by the imaging device can be configured for use aligning a position of an outlet of a fuel injector with respect to a position of the duct.

20 Claims, 7 Drawing Sheets

(51) Int. Cl.
*F01D 21/00* (2006.01)
*F02B 23/06* (2006.01)

(58) Field of Classification Search
USPC ..... 123/445
See application file for complete search history.

(56) References Cited

U.S. PATENT DOCUMENTS

| | | | | |
|---|---|---|---|---|
| 9,587,606 | B2 | 3/2017 | Anders et al. | |
| 9,909,549 | B2 | 3/2018 | Mueller | |
| 10,012,196 | B1 * | 7/2018 | Qi | F02B 23/0648 |
| 10,138,855 | B2 * | 11/2018 | Mueller | F02P 23/02 |
| 10,161,626 | B2 | 12/2018 | Mueller | |
| 2016/0097360 | A1 * | 4/2016 | Mueller | F02M 61/1813 123/294 |
| 2016/0298531 | A1 * | 10/2016 | Anders | F02M 61/1806 |
| 2017/0114998 | A1 * | 4/2017 | Mueller | F02B 1/06 |
| 2018/0106595 | A1 * | 4/2018 | Christoph | G01B 11/007 |
| 2018/0258836 | A1 * | 9/2018 | Anders | F02B 23/00 |
| 2019/0063391 | A1 * | 2/2019 | Martin | F02M 61/1806 |
| 2019/0218959 | A1 * | 7/2019 | Klingbeil | F02B 23/0654 |
| 2020/0040857 | A1 * | 2/2020 | Kurtz | F02M 61/182 |
| 2020/0191045 | A1 * | 6/2020 | Gubba | F02B 23/0696 |

FOREIGN PATENT DOCUMENTS

| | | |
|---|---|---|
| JP | 1976042311 | 3/1976 |
| JP | 3286124 | 12/1991 |
| JP | 5086864 | 4/1993 |
| JP | 5272338 | 10/1993 |
| JP | 5296045 | 11/1993 |
| JP | 2002276373 | 9/2002 |
| JP | 2004038449 | 11/2004 |

OTHER PUBLICATIONS

R.K. Gehmlich, Using ducted fuel injection to attenuate or prevent soot formation in mixing-controlled combustion strategies for engine applications, Jun. 28, 2018, Applied Energy, pp. 3-7 (Year: 2018).*

* cited by examiner

DUCTED FUEL INJECTION SYSTEM ALIGNMENT DEVICE

STATEMENT OF GOVERNMENTAL INTEREST

This invention was made with Government support under Contract No. DE-NA0003525 awarded by the United States Department of Energy/National Nuclear Security Administration. The U.S. Government has certain rights in the invention.

BACKGROUND

Most modern engines are direct injection engines, such that each combustion cylinder of the engine includes a dedicated fuel injector configured to inject fuel directly into a combustion chamber. While direct injection engines represent an improvement in engine technology over past designs (e.g., carburetors) with regard to increased engine efficiency and reduced emissions, direct injection engines can produce relatively high levels of certain undesired emissions.

Engine emissions can include soot, which results from combustion of a fuel-rich and oxygen-lean fuel mixture. Soot comprises small carbon particles created by the fuel-rich regions of diffusion flames commonly created in a combustion chamber of an engine. Soot is an environmental hazard, an emission regulated by the Environmental Protection Agency (EPA) in the United States of America, and the second most important climate-forcing species (carbon dioxide being the most important). Currently, soot is removed from the exhaust of gasoline and diesel engines by large and expensive particulate filters in the exhaust system. Other post-combustion treatments may also have to be utilized, such as NO selective catalytic reduction, a NO trap, oxidation catalyst, etc. These after-treatment systems require monitoring and periodic maintenance to enable continued and effective reduction of soot/particulates and other undesired emissions, and accordingly add further cost to an engine system both in terms of initial equipment cost and subsequent maintenance.

A focus of combustion technologies is burning fuel in leaner mixtures because such mixtures tend to produce less soot, NOR, and potentially other regulated emissions such as hydrocarbons (HC) and carbon monoxide (CO). One such combustion strategy is Leaner Lifted-Flame Combustion (LLFC). LLFC is a combustion strategy that does not produce soot because combustion occurs at equivalence ratios less than or equal to approximately two. The equivalence ratio is the actual ratio of fuel to oxidizer divided by the stoichiometric ratio of fuel to oxidizer. LLFC can be achieved by enhanced local mixing of fuel with the charge-gas (i.e., air with or without additional gas-phase compounds, "diluents") in the combustion chamber.

SUMMARY

The following is a brief summary of subject matter that is described in greater detail herein. This summary is not intended to be limiting as to the scope of the claims.

Ducted fuel injection is a means to facilitate the achievement of LLFC and thereby lower emissions. Ducted fuel injection involves injecting each fuel spray along the axis of a small cylindrical duct within the combustion chamber to achieve more-complete local premixing at or near the end of the duct where ignition occurs. Ducted fuel injection has been shown to curtail soot dramatically and hydrocarbon emissions to a lesser extent in engine experiments over a range of operating conditions. Low soot and hydrocarbon emissions have been achieved even when relatively high levels of charge-gas dilution are employed. This characteristic enables simultaneous, cost-effective, dramatic attenuation of both soot (via ducted fuel injection) and $NO_x$ (via dilution), thereby breaking the long-standing "soot/$NO_x$ trade-off" for diesel engines. While ducted fuel injection is fully compatible with current commercial diesel fuel, it is also synergistic with oxygenated renewable fuels. Hence, larger reductions of soot and net carbon emissions can be achieved when ducted fuel injection and renewable fuels are used together, suggesting a promising path toward a new generation of high-efficiency, sustainable, high-performance engines and fuels.

In an exemplary embodiment, described herein is a device for alignment of one or more ducts in a ducted fuel injection system with respect to a common fuel injector. The alignment device comprises a mounting block removably attachable to a duct of the ducted fuel injection system. The mounting block can include a passageway extending therethrough. The passageway can align with the duct when the mounting block is attached to the duct. The alignment device further comprises an imaging device configured to capture an image viewing through the duct toward an outlet of a fuel injector. A portion of the imaging device can extend in the passageway. The alignment device additionally comprises a centering structure configured to align a portion of the imaging device with a central axis of the duct. The image captured by the imaging device can be configured for use aligning a position of an outlet of a fuel injector with respect to a position of the duct.

A method of using a ducted fuel injection system alignment device includes securing a mounting body to a duct of the ducted fuel injection system. The mounting body can include a passageway extending therethrough. The passageway can include a portion configured to receive a portion of the duct. The method can further include attaching a centering structure to the duct, wherein the centering structure is placed in an interior of the duct. The method can additionally include passing imaging hardware through the passageway in the mounting body and into the duct. The imaging hardware can be configured to capture an image viewing through the duct toward an outlet of a fuel injector. The image captured by the imaging device can be configured for use aligning a position of an outlet of a fuel injector with respect to a position of the duct.

Further, in accordance with various aspects, provided is a ducted fuel injection system alignment device comprising a mounting block removably attachable to a duct of the ducted fuel injection system. The mounting block can include a passageway extending therethrough. The passageway can align with the duct when the mounting block is attached to the duct. The alignment device can further include a camera with a lens and/or image relaying system attached thereto configured to capture an image viewing through the duct toward an outlet of a fuel injector. The lens and/or image relaying system could be a fiberscope, a borescope, an endoscope, or similar system. A portion of the lens and/or image relaying system can extend in the passageway. The alignment device further includes a hollow cylinder removably insertable into an interior of the duct. An outer diameter of the cylinder can be sized based on an inner diameter of the duct and an inner diameter of the cylinder can be sized based on the size of the lens and/or image relaying system. The hollow cylinder can be configured to align a portion of the imaging device with a central axis of the duct. The image captured by the camera can be configured for use aligning a position of an outlet of a fuel injector with respect to a position of the duct.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

DETAILED DESCRIPTION

Figure 1:
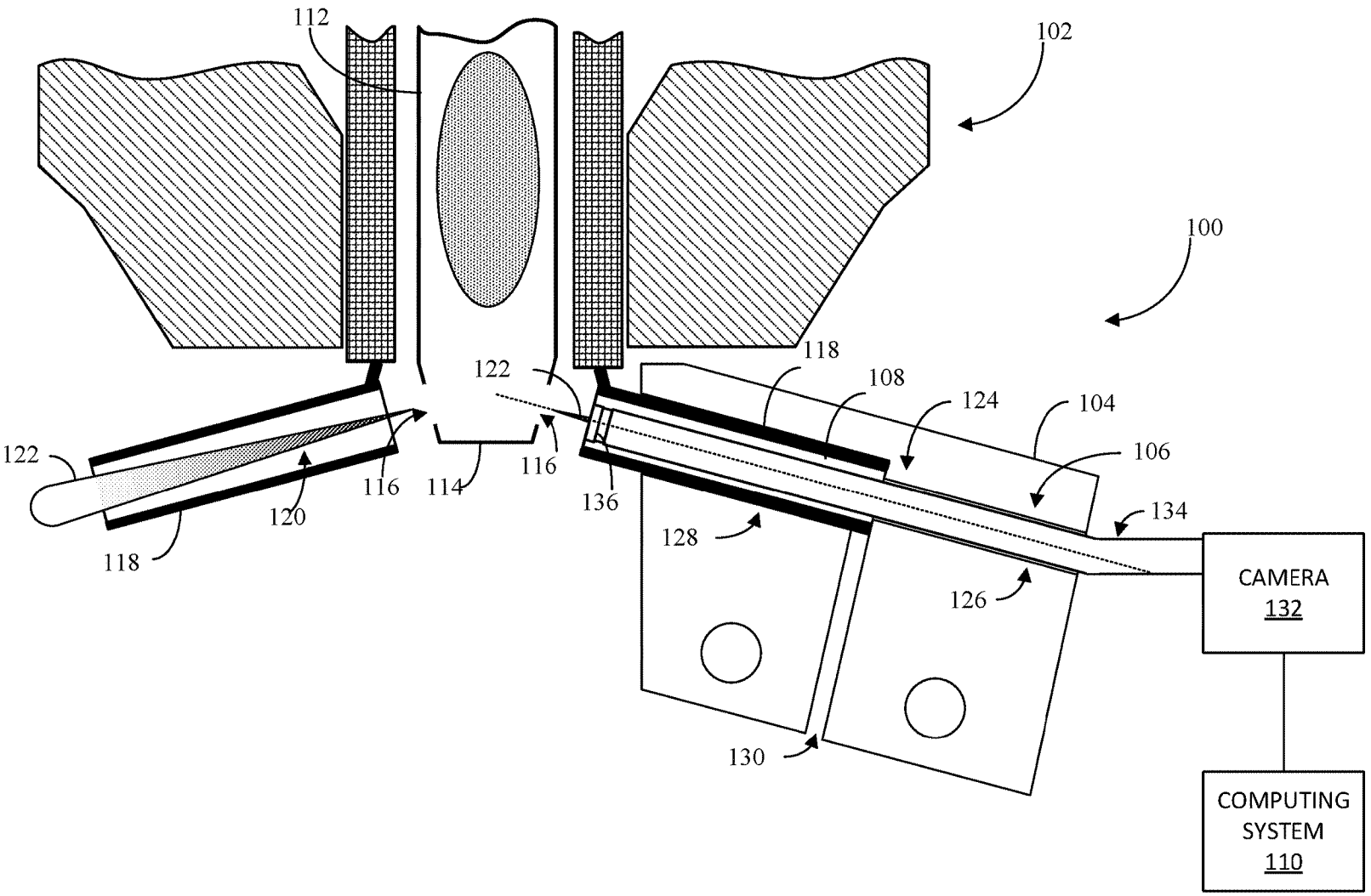
FIG. 1 illustrates an exemplary alignment device for a ducted fuel injection system.

Various technologies pertaining to a device for alignment of one or more ducts in a ducted fuel injection system are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details.

In reference to the disclosure herein, for purposes of convenience and clarity only, directional terms, such as, top, bottom, left, right, up, down, upper, lower, over, above, below, beneath, rear, and front, may be used. Such directional terms should not be construed to limit the scope of the features described herein in any manner. It is to be understood that embodiments presented herein are by way of example and not by way of limitation. The intent of the following detailed description, although discussing exemplary embodiments, is to be construed to cover all modifications, alternatives, and equivalents of the embodiments as may fall within the spirit and scope of the features described herein.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something and is not intended to indicate a preference.

Disclosed is a device for alignment of one or more ducts in a ducted fuel injection system. More particularly, the device can be used to determine alignment of a duct relative to a fuel injector of the ducted fuel injection system. The device can capture an image viewing through the duct toward an outlet of a fuel injector as a jet of fuel travels toward the duct that can be used by a computing system to determine the alignment. The computing system can determine the alignment by calculating a distance between a central axis of the duct and a central axis of the jet of fuel.

Turning to FIG. 1, illustrated is a cross-sectional view of an embodiment of a ducted fuel injection system alignment device 100 that is attached to a ducted fuel injection system 102. The alignment device 100 includes a mounting block 104 for removably attaching the aligning device 100 to the ducted fuel injection system 102, an imaging device 106 for capturing an image viewing through the ducted fuel injection system 102, and centering structure 108 for orienting the imaging device 106. The alignment device 100 may yet further include and/or be connected to a computing system 110 that can be configured to use an image captured by the imaging device 106 to determine alignment for the ducted fuel injection system 102, as will be explained in detail below.

The ducted fuel injection system 102 includes a fuel injector 112 that is mounted in a cylinder head. The injector 112 has a tip 114 that protrudes into a combustion chamber such that it can directly inject fuel into the combustion chamber. The injector tip 114 can include a number of openings 116 (orifices) through which fuel is injected into the combustion chamber. Each opening 116 can be of a particular shape, e.g., a circular opening, and further, each opening 116 can have a particular opening diameter, D.

Each opening 116 leads to a duct 118 which can be utilized to direct fuel injected through the opening 116 into the combustion chamber. The ducted fuel injection system 102 can include any suitable number of ducts 118 organized in any suitable arrangement for directing the fuel from the injector tip 114 into the combustion chamber. Moreover, each duct 118 can take any suitable shape for directing the fuel, such as a hollow cylinder as illustrated in FIG. 1.

As the respective jet of fuel travels through a bore 120 of each respective duct 118, a pressure differential is generated inside of the duct 118 such that charge-gas in the combustion chamber is also drawn into the duct 118. The charge-gas mixes rapidly with the fuel due to intense turbulence created by the high velocity gradients between the duct bore 120 (at which the fluid velocity is zero) and the centerline of a fuel jet 122 traveling in the duct 118 (at which the fluid velocity is large). The turbulent conditions can enhance the rate of mixing between the jet of fuel 122 and the drawn charge-gas, wherein the degree of mixing of the fuel 122 and charge-gas in the bore 120 can be greater than a degree of mixing that would occur in a conventional configuration, wherein the jet of fuel 122 is injected into the charge-gas filled combustion chamber directly from the openings 116 without passage through ducts. For the conventional configuration, the jet of fuel 122 would undergo a lesser amount of turbulent mixing with the charge-gas than is enabled by passing the jet of fuel 122 through the duct 118.

The amount of turbulent mixing of the jet of fuel 122 and the drawn charge-gas can be a function of a distance difference between the centerline of the fuel jet 122 entering the duct 118 and a centerline of duct 118. More particularly, the closer the centerline of the fuel jet 122 is to the centerline of the duct 118, the higher the amount of turbulent mixing and the lower the amount of soot generated in the combustion chamber during ignition and subsequent combustion of the locally premixed mixtures. To that end, the alignment device 100 is used to align one or more ducts 118 relative to the injector tip 114, such that a centerline of a jet of fuel is coincident with the centerline of the duct 118. As briefly mentioned above, the alignment device 100 includes a mounting block 104 for removably attaching the aligning device 100 to the ducted fuel injection system 102, an imaging device 106 for capturing an image, and centering structure 108 for orienting the imaging device 106.

Figure 2:
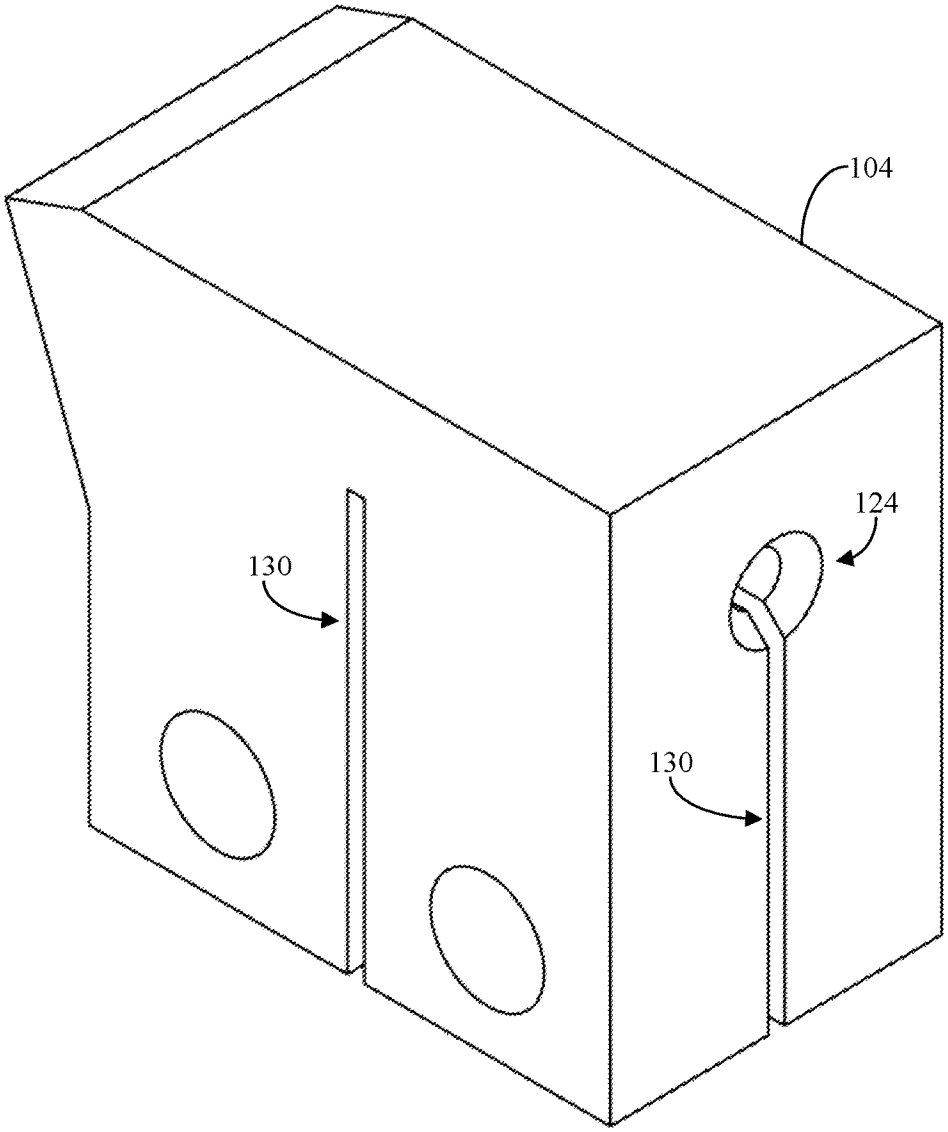
FIG. 2 illustrates an exemplary mounting body for an alignment device.

As illustrated in FIGS. 1 and 2, the mounting block 104 may be further configured to retain a portion of the imaging device 106 and/or the centering structure 108 when the mounting block 104 is secured to the ducted fuel injection system 102. For instance, the mounting block 104 can be shaped to house the portion of the imaging device 106 and/or the centering structure 108. The mounting block 104 can be removably secured to any suitable location on the ducted fuel injection system 102. The attachment location may depend on the shape and/or size of the mounting block 104, the imaging device 106, the centering structure 108, and/or the like. For instance, in the illustrated embodiment, the mounting block 104 is secured at the duct 118. In another embodiment, the mounting block 104 can be secured to the injector 112.

The mounting block 104 may include an indentation to receive the imaging device 106 and/or the centering structure 108. The indentation can extend for any suitable length within the mounting block 104 to retain the portion of the imaging device 106 and/or centering structure 108 therein. For instance, in the illustrated embodiment, the indentation extends through the mounting block 104 to form a passageway 124. The passageway 124 can have a uniform cross-section and/or can have a plurality of various cross-sections. In the illustrated embodiment, the passageway 124 comprises a first portion 126 with a first cross-section and a second portion 128 with a second cross-section that is larger than the first cross-section. The first portion 126 can be shaped to accommodate the imaging device 106 while the second portion 128 can be shaped to accommodate the imaging device 106 and the centering structure 108.

As can be seen in FIG. 1 and more clearly in FIG. 2, in addition to the passageway 124, the mounting block 104 may further include one or more slits 130 that extend from the passageway 124 to an outer surface of the mounting block 104. The slit 130 permits the mounting block 104 to flex. For instance, the mounting block 104 may flex as the imaging device 106 and/or the centering structure 108 is inserted into the passageway 124. Moreover, the mounting block 104 may flex as it is attached to the ducted fuel injection system 102.

In addition to retaining the imaging device 106 and/or the centering structure 108, the indentation can be further configured to retain a portion of a duct 118 such that the mounting block 104 can be attached to the ducted fuel injection system 102 by inserting the duct 118 into the indentation. In the illustrated embodiment, the second portion 128 of the passageway 124 is further shaped to accommodate the portion of the duct 118.

In the illustrated embodiment, the imaging device 106 for capturing an image viewing through the duct 118 toward an outlet of a fuel injector 116 comprises a camera 132 and a lens and/or image relaying system 134 attached thereto; however, the imaging device 106 can comprise any suitable components. The camera 132 and the lens and/or image relaying system 134 can be positioned at any suitable locations, such as the camera 132 being located outside the ducted fuel injection system 102 and the lens and/or image relaying system 134 can extend from the camera 132 into the ducted fuel injection system 102 through the passageway 124 in the mounting block 104. In an embodiment, the camera 132 comprises a high-speed camera with a high frame rate, such as 5000 frames per second. In another embodiment, the lens and/or image relaying system 134 comprises a fiberscope, a borescope, an endoscope, and/or the like.

The imaging device 106 may further include an illumination bundle configured to provide illumination during image capture. The illumination bundle can include a high output light emitting diode (LED) light that provides illumination to an outside end of the lens and/or image relaying system 134. The illumination bundle may depend on the type of camera 132 used, size and/or shape of the lens and/or image relaying system 134, the jet of fuel 122 being observed, or the like.

Any suitable shape and/or size of centering structure 108 can be used to align the lens and/or image relaying system 134 with a central axis of the duct 118. In the illustrated embodiment, the centering structure 108 comprises a hollow cylinder with an interior diameter sized based on a diameter of the lens and/or image relaying system 134 and an exterior diameter sized based on an interior diameter of the duct 118. The cylinder can be machined such that a center of the cylinder aligns with the center axis of the duct 118 to align the lens and/or image relaying system 134 with the center axis of the duct 118 when the lens and/or image relaying system 134 is inserted into the cylinder.

The centering structure 108 can further include a transparent or translucent window 136 at an end of the cylinder to protect a lens of the image relaying system 134 from the fuel jet 122 emitted from the injector 114. Because the window 136 is disposed between the lens of the image relaying system 134 and the opening 116 of the injector 114, the camera 132 captures the image(s) of the fuel jet 122 impacting on the window 136.

The imaging device 106, the centering structure 108, and/or the duct 118 can be organized in the second portion 128 in any suitable arrangement. In the illustrated embodiment, the duct 118 is sandwiched between the centering structure 108 and an interior wall of the second portion 128 of the passageway 124. Sandwiching the duct 118 between the centering structure 108 and the interior wall helps to center the centering structure 108 within the duct 118 and, by extension, helps to center the imaging device 106 within the duct 118, as described above.

The mounting body 104 and/or the centering structure 108 can be formed of any suitable material. In one embodiment, the centering structure 108 can be formed of machinable metal, such as stainless steel. Metal can be used for the centering structure 108 to provide rigidity and minimize friction as the centering structure 108 is moved within the duct 118 and/or the imaging device 106 is inserted into the centering structure 108.

Figure 3:
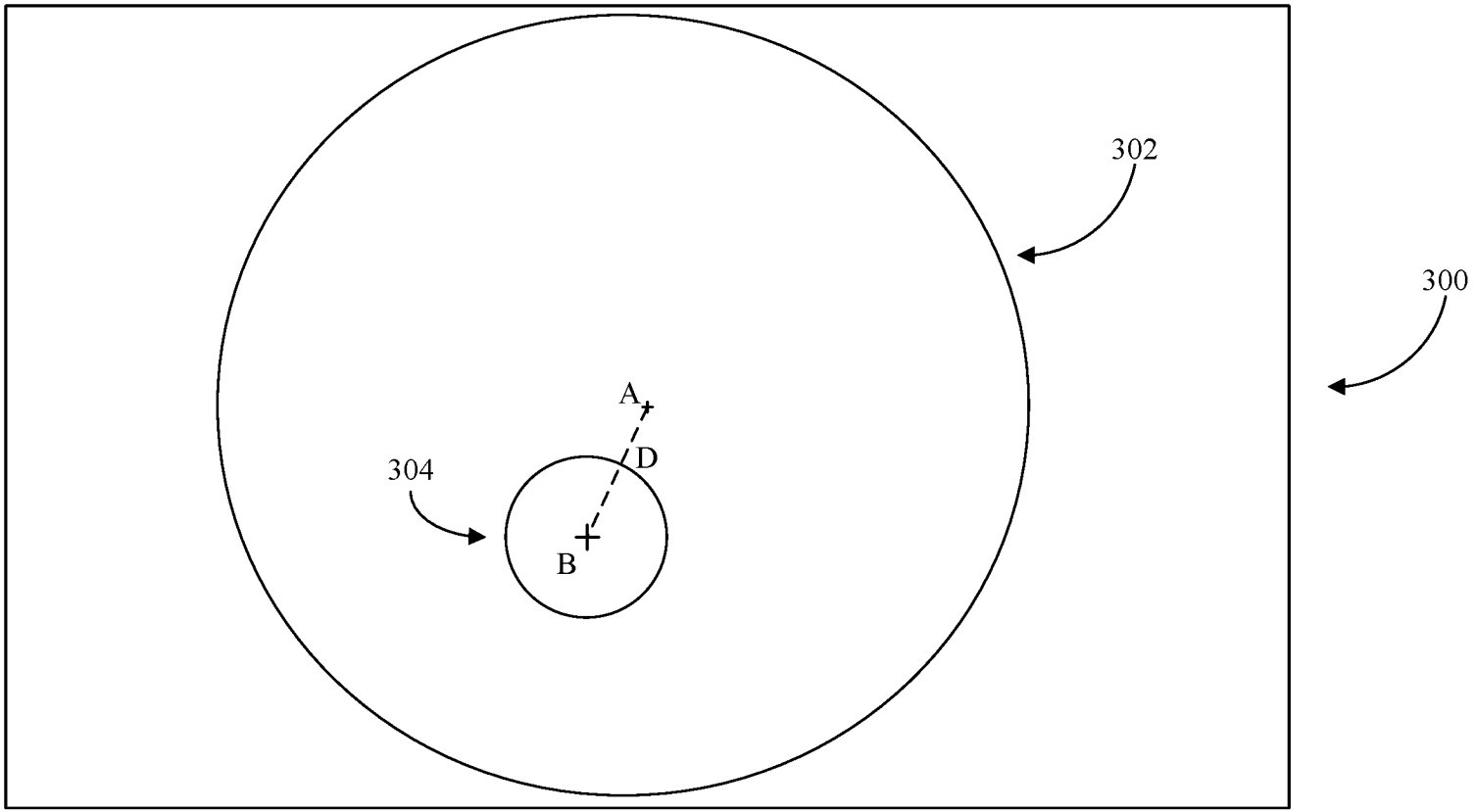
FIG. 3 illustrates an exemplary image captured by an alignment device.

Turning now to FIG. 3, illustrated is an image 300 viewing through the duct 118 toward an outlet of a fuel injector 116 captured by the imaging device 106 (such as the camera 132 and lens and/or image relaying system 134) as the jet of fuel 122 impacts the window 136. The image 300 can be transmitted to the computing system 110 for analysis. For instance, the computing system 110 can be configured to determine a distance between a central axis of the duct 118 and a central axis of the jet of fuel 122. Because the imaging device 106 captures the image from within the duct 118, an end of the duct 118 where the jet of fuel 122 enters the duct 118 is captured, as illustrated by the outline 302 in FIG. 3. Further, because the centering structure 108 aligns the lens and/or image relaying system 134 with the central axis of the duct 118, a central point A of the image 300 represents the central axis of the duct 118. In another embodiment, the central axis of the duct 118 can be determined based on information in an image captured by the imaging device 106. For instance, the lens and/or image relaying system 134 need not be aligned with the central axis of the duct 118 and structure captured in the image can be used to locate the central axis of the duct 118. For example, the end of the duct 118 captured in an image can be used to calculate a location of a central axis of the duct 118 in the image.

In addition, the image 300 captures the jet of fuel 122 impacting the window 136 of the centering structure 108. Because the illumination bundle lights the field of view of the lens and/or image relaying system 134, the image 300 captures light reflecting from the jet of fuel 122 impacting on the window 136 while other light passes through without reflection. This reflection of light is illustrated by the shape 304 in the image 300. The computing system 110 can then perform a center of mass analysis on the shape 304 to determine a central axis of the jet of fuel 122 at impact with the window 136. In the illustrated embodiment, the shape 304 is circular and the computing system 110 can determine the central axis by determining a center point B of the shape 304. In another embodiment, the computing system 110 performs a gradient analysis where intensities are determined across the image 300 to determine maximum and minimum intensities to locate the central axis of the jet of fuel 122.

Subsequent to determining the center point A for the duct 118 and the center point B for jet of fuel 122, the computing system can calculate a distance D between point A and point B. The calculated distance D can be used to adjust the relative positions of the injector 112 and the duct 118 to modify the distance D to fall within a particular threshold. In one embodiment, the duct 118 is moved relative to the injector 112 to modify the distance D.

Turning now to FIGS. 4 and 5A-5C, in order to increase turbulent mixing, it may be desirable to determine an alignment for a plurality of ducts with respect to a common injector. Each duct in the ducted fuel injection system can have its position be separately modified as desired and/or the ducts can be connected together and modifying the position of one duct would modify the position of multiple ducts.

Figure 4:
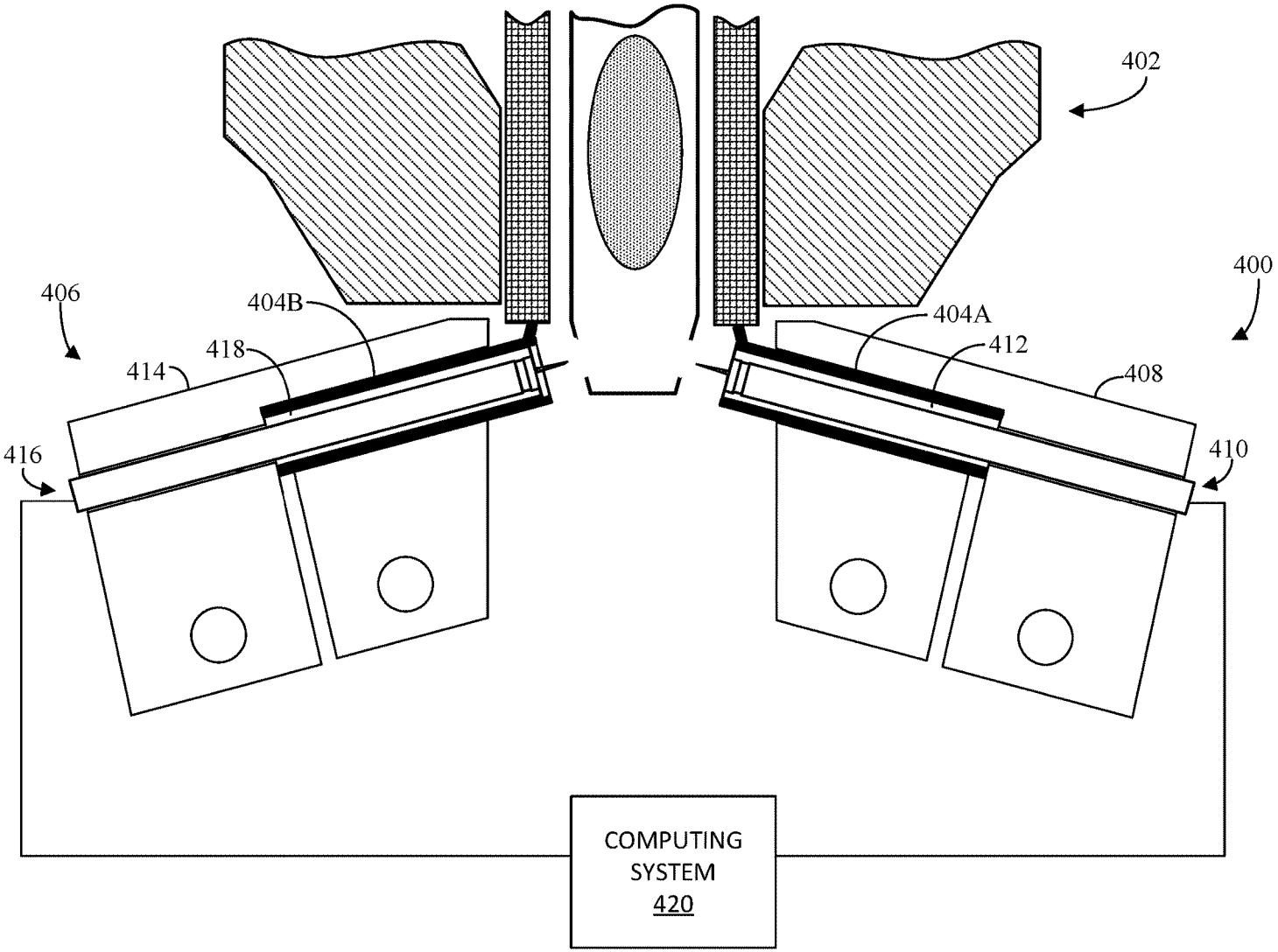
FIG. 4 illustrates another exemplary alignment device for a ducted fuel injection system.

In FIG. 4, a first alignment device 400 is secured to a first duct 404A of a ducted fuel injection system 402 and a second alignment device 406 is secured to a second duct 404B of the ducted fuel injection system 402. The first alignment device 400 and second alignment device 406 can be similar, as illustrated, and/or can vary.

In the illustrated embodiment, the first alignment device 400 comprises a mounting block 408 (similar to the mounting block 104 described above), an imaging device 410 (similar to the imaging device 106 described above), and centering structure 412 (similar to the centering structure 108 described above). Similarly, the second alignment device 406 comprises a mounting block 414, an imaging device 416, and centering structure 418. The imaging device 410 of the first alignment device 400 and the imaging device 416 of the second alignment device 406 can be connected to the same computing system 420, as illustrated, and/or can be connected to separate computing systems.

Figure 5A:
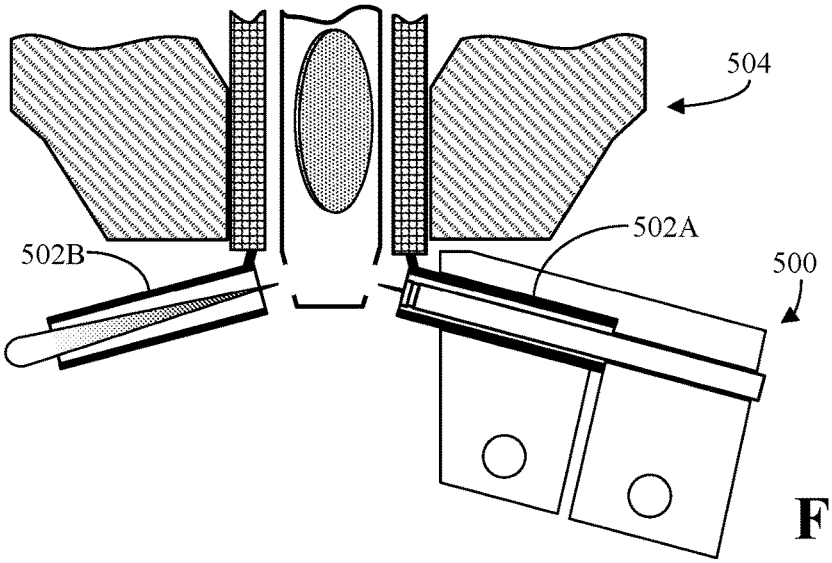
FIGS. 5A-5C illustrate an exemplary embodiment of using an alignment device.
Figure 5B:
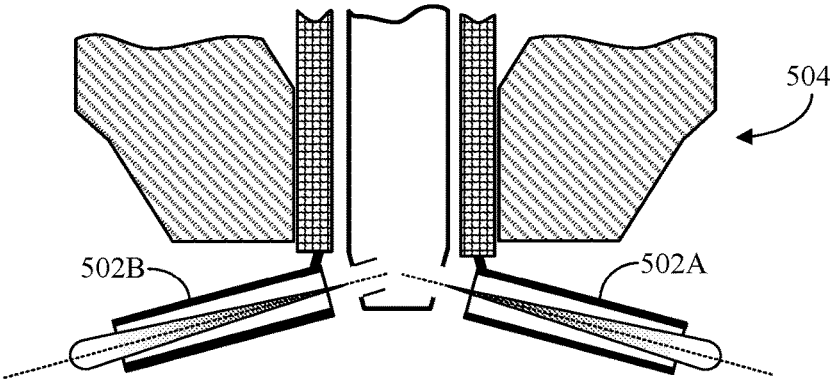
Figure 5C:
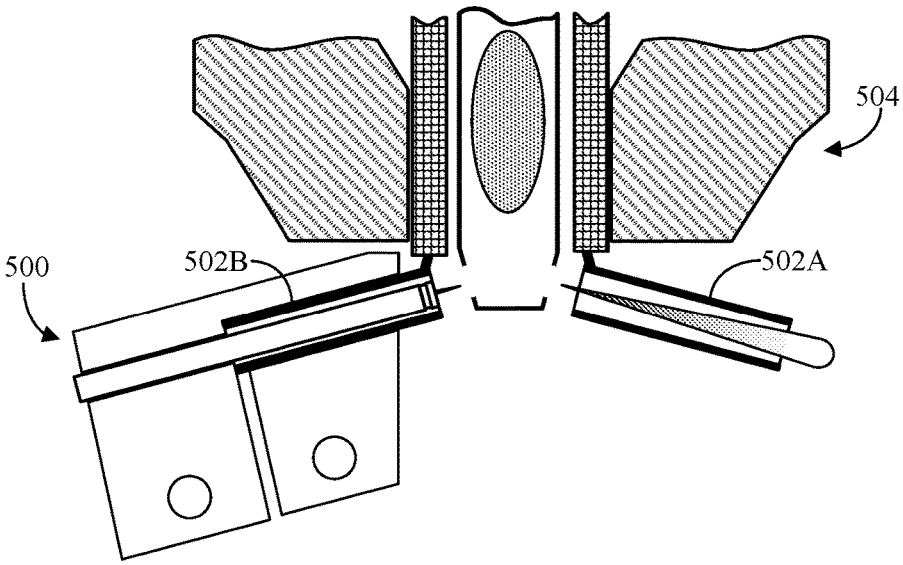

Turning now to FIGS. 5A-5C, instead of or in addition to using separate alignment devices, the same alignment device can be used for multiple ducts. In the embodiment illustrated in FIG. 5A, an alignment device 500 can be attached to a first duct 502A of a ducted fuel injection system 504 to determine alignment for the first duct 502A. As illustrated in FIG. 5B, the alignment device 500 can be removed from first duct 502A. Then, as illustrated in FIG. 5C, the alignment device 500 can be attached to a second duct 502B of the ducted fuel injection system 504 to determine alignment for the second duct 502B.

Figure 6:
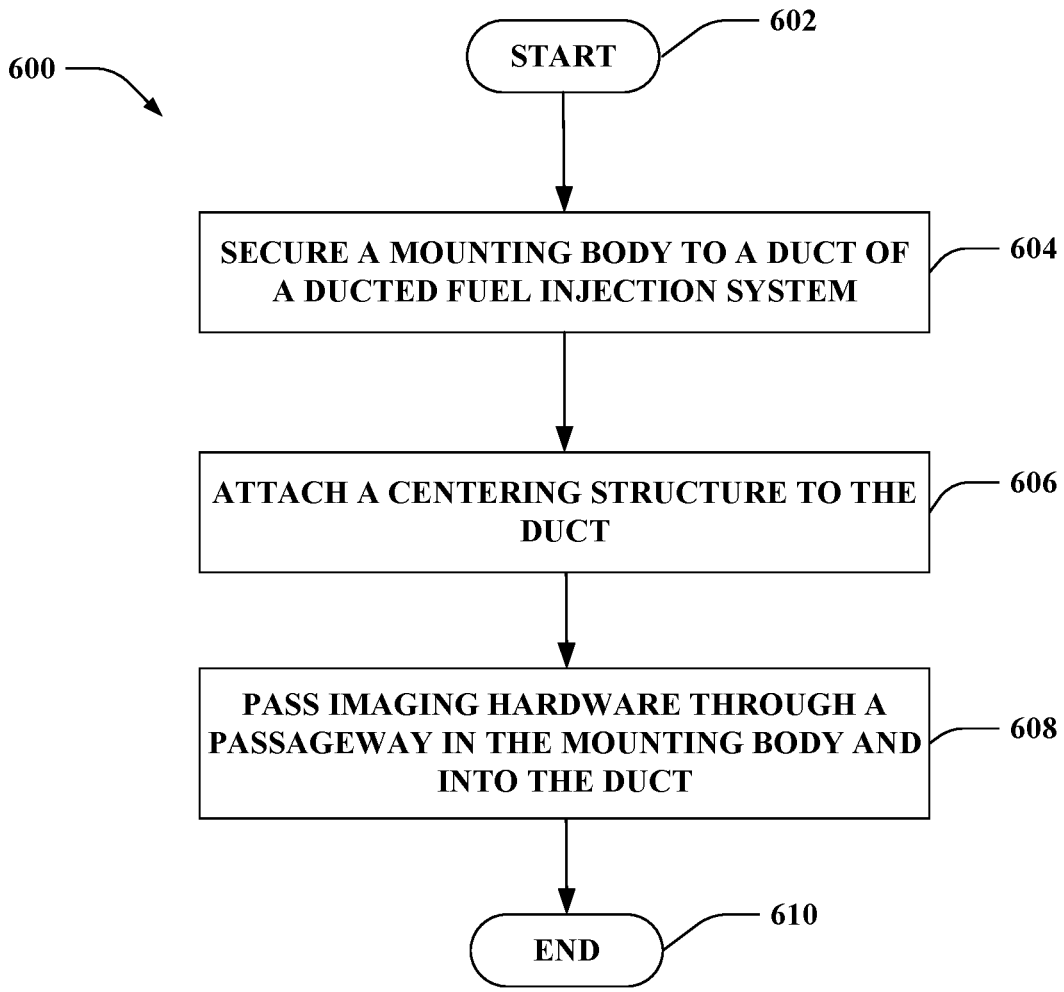
FIG. 6 is a flow diagram that illustrates an exemplary methodology for using a ducted fuel injection system alignment device.
Figure 7:
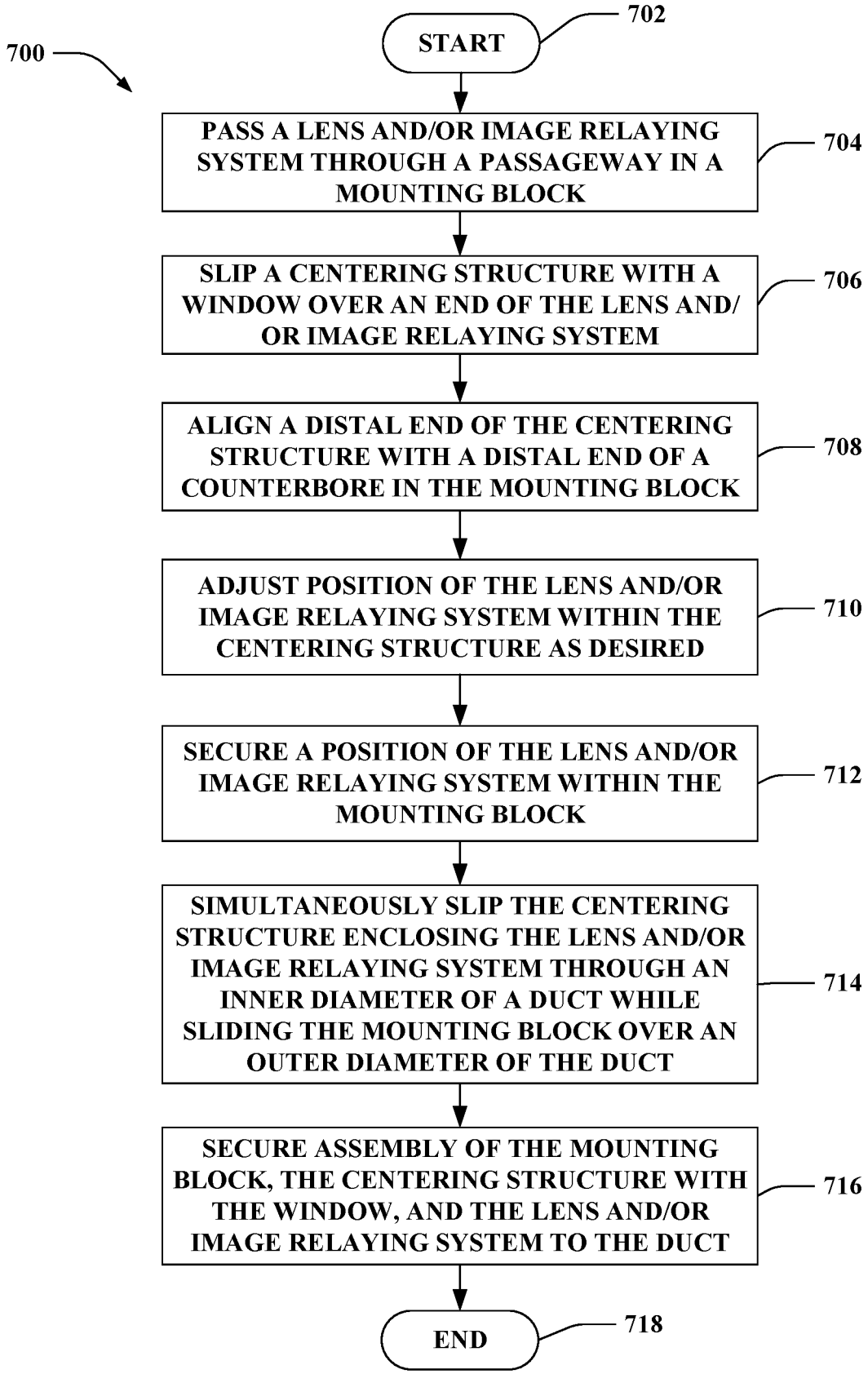
FIG. 7 is a flow diagram that illustrates another exemplary methodology for using a ducted fuel injection system alignment device.

FIGS. 6 and 7 illustrate exemplary methodologies relating to using a ducted fuel injection system alignment device. While the methodologies are shown as being a series of acts that are performed in a sequence, it is to be understood and appreciated that the methodologies are not limited by the order of the sequence. For example, some acts can occur in a different order than what is described herein. In addition, an act can occur concurrently with another act. Further, in some instances, not all acts may be required to implement a methodology described herein.

As illustrated in FIG. 6, a methodology 600 starts at 602, and at 604, a mounting body is secured to a duct of the ducted fuel injection system. The mounting body can include a passageway extending therethrough. The passageway can include a portion configured to receive a portion of the duct. At 606, a centering structure is attached to the duct. The centering structure can be placed in an interior of the duct. At 608, imaging hardware is passed through the passageway in the mounting body and into the duct. The imaging hardware can be configured to capture an image viewing through the duct toward an outlet of a fuel injector. The image captured by the imaging device can be configured for use aligning a position of an outlet of a fuel injector in the ducted fuel injection system with respect to a position of the duct. The methodology 600 concludes at 610.

In one embodiment of the methodology 600, passing the imaging hardware through the passageway in the mounting body includes passing the imaging hardware through the centering structure. Passing the imaging hardware through the centering structure can align a portion of the imaging device with a central axis of the duct.

In another embodiment, the methodology 600 further includes transmitting the image to a computing system. The methodology 600 yet further includes determining, by way of the computing system, a distance between the central axis of the duct and a central axis of fluid traveling in the duct.

In a version of this embodiment, the methodology 600 further includes adjusting at least one of the position of the outlet of the fuel injector or the position of the duct such that a distance between the central axis of the duct and the central axis of fluid traveling in the duct is minimized.

In a variant of this version, adjusting the at least one of the position of the outlet of the fuel injector or the position of the duct comprises moving the duct from a first location to a second location.

In a further embodiment of the methodology 600, securing the mounting body to the duct comprises securing a locking structure on the mounting block to a corresponding locking structure on the duct.

In yet another embodiment, the methodology 600 further includes removing the mounting body and the centering structure from the duct. The methodology 600 additionally includes securing the mounting body to a second duct of the ducted fuel injection system. The methodology 600 yet further includes attaching the centering structure to the second duct. The methodology 600 also includes passing imaging hardware through the passageway in the mounting body and into the second duct. The imaging hardware can be configured to capture an image viewing through the second duct toward a corresponding outlet of a fuel injector.

Turning now to FIG. 7, illustrated is another methodology 700 relating to using a ducted fuel injection system alignment device. The methodology 700 starts at 702, and at 704, a lens and/or image relaying system is passed through a passageway in a mounting block. At 706, a centering structure with a window is slipped over an end of the lens and/or image relaying system. At 708, a distal end of the centering structure is aligned with a distal end of a counterbore in the mounting block. At 710, a position of the lens and/or image relaying system is adjusted within the centering structure as desired. At 712, a position of the lens and/or image relaying system is secured within the mounting block. At 714, the centering structure enclosing the lens and/or image relaying system is slipped through an inner diameter of a duct simultaneously with the mounting block being slid over an outer diameter of the duct. At 716, the assembly of the mounting block, the centering structure with the window, and the lens and/or image relaying system is secured to the duct. The methodology 700 concludes at 718.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An alignment device for a ducted fuel injection system, the alignment device comprising:

a mounting block removably attachable to a duct of the ducted fuel injection system, wherein the mounting block includes a passageway extending therethrough, wherein the passageway aligns with the duct when the mounting block is attached to the duct;

an imaging device configured to capture an image viewing through the duct toward an outlet of a fuel injector, wherein a portion of the imaging device extends into the passageway; and a centering structure configured to align the portion of the imaging device with a central axis of the duct, wherein the image captured by the imaging device is used to align a position of the outlet of the fuel injector with respect to a position of the duct.

2. The alignment device of claim 1, wherein the centering structure comprises a hollow cylinder, wherein an outer diameter of the hollow cylinder is sized based on an inner diameter of the duct, wherein an inner diameter of the hollow cylinder is sized based on a dimension of the imaging device.

3. The alignment device of claim 2, wherein the centering structure further includes a window formed at an end of the hollow cylinder, wherein the imaging device captures the image through the window toward the outlet of the fuel injector.

4. The alignment device of claim 1, wherein the passageway comprises a first portion with a first cross-section and a second portion with a second cross-section, wherein the first cross-section and the second cross-section are different, wherein the first cross-section is shaped to receive and surround a portion of the duct.

5. The alignment device of claim 1, wherein the imaging device comprises a camera, with a lens and/or an image relaying system attached thereto, wherein the image relaying system extends into the passageway.

6. The alignment device of claim 5, wherein the imaging device further comprises an illumination bundle attached adjacent the lens.

7. The alignment device of claim 5, wherein the image relaying system comprises at least one of a fiberscope, borescope, or an endoscope.

8. The alignment device of claim 1, further comprising:

a computing system configured to receive the image captured by the imaging device, wherein the computing system is further configured to determine a distance between the central axis of the duct and a central axis of fluid traveling in the duct.

9. The alignment device of claim 1, wherein the mounting block includes a locking structure that interacts with a corresponding locking structure on the duct to secure the mounting block at a particular location relative to the duct.

10. The alignment device of claim 1, further comprising:

a second mounting block removably attachable to a second duct of the ducted fuel injection system, wherein the second mounting block includes a second passageway extending therethrough, wherein the second passageway aligns with the second duct when the second mounting block is attached to the second duct;

a second imaging device configured to capture a second image viewing through the second duct toward a second outlet of the fuel injector, wherein a portion of the second imaging device extends into the second passageway; and a second centering structure configured to align the portion of the second imaging device with a central axis of the second duct, wherein the second image captured by the second imaging device is used to align a position of the second outlet of the fuel injector with respect to a position of the second duct.

11. The alignment device of claim 10, further comprising:

a computing system configured to receive the image captured by the imaging device and the second image captured by the second imaging device, wherein the computing system is further configured to determine a distance between the central axis of the duct and a central axis of fluid traveling in the duct, wherein the computing system is further configured to determine a second distance between the central axis of the second duct and a second central axis of fluid traveling in the second duct.

12. A method of using an alignment device for a ducted fuel injection system, the method comprising:

securing a mounting body to a duct of the ducted fuel injection system, wherein the mounting body includes a passageway extending therethrough, wherein the passageway includes a portion configured to receive a portion of the duct;

attaching a centering structure to the duct, wherein the centering structure is placed in an interior of the duct;

passing imaging hardware through the passageway in the mounting body and into the duct, wherein the imaging hardware is configured to capture an image viewing through the duct toward an outlet of a fuel injector, wherein the image captured by the imaging hardware is used to align a position of the outlet of the fuel injector with respect to a position of the duct.

13. The method of claim 12, wherein passing the imaging hardware through the passageway in the mounting body includes passing the imaging hardware through the centering structure, wherein passing the imaging hardware through the centering structure aligns a portion of the imaging hardware with a central axis of the duct.

14. The method of claim 12, further comprising:

transmitting the image captured by the imaging hardware to a computing system; and determining, via the computing system, a distance between a central axis of the duct and a central axis of fluid traveling in the duct.

15. The method of claim 14, further comprising:

adjusting at least one of the position of the outlet of the fuel injector or the position of the duct such that the distance between the central axis of the duct and the central axis of fluid traveling in the duct is minimized.

16. The method of claim 15, wherein adjusting the at least one of the position of the outlet of the fuel injector or the position of the duct comprises moving the duct from a first location to a second location.

17. The method of claim 12, wherein securing the mounting body to the duct comprises securing a locking structure on the mounting block to a corresponding locking structure on the duct.

18. The method of claim 12, further comprising:

removing the mounting body and the centering structure from the duct;

securing the mounting body to a second duct of the ducted fuel injection system;

attaching the centering structure to the second duct; and passing the imaging hardware through the passageway in the mounting body and into the second duct, wherein the imaging hardware is configured to capture an image viewing through the second duct toward a second outlet of the fuel injector.

19. An alignment device for a ducted fuel injection system, the alignment device comprising:

a mounting block removably attachable to a duct of the ducted fuel injection system, wherein the mounting block includes a passageway extending therethrough, wherein the passageway aligns with the duct when the mounting block is attached to the duct;

a camera with a lens and/or an image relaying system attached thereto configured to capture an image viewing through the duct toward an outlet of a fuel injector, wherein a portion of the lens and/or image relaying system extends into the passageway; and a hollow cylinder removably insertable into an interior of the duct, wherein an outer diameter of the hollow cylinder is sized based on an inner diameter of the duct, wherein an inner diameter of the hollow cylinder is sized based on a dimension of the lens and/or image relaying system, wherein the hollow cylinder is configured to align the portion of the lens and/or image relaying system with a central axis of the duct, wherein the image captured by the camera is used to align a position of the outlet of the fuel injector with respect to a position of the duct.

20. The alignment device of claim 19, wherein the hollow cylinder comprises stainless steel.

* * * * *